US009223246B2

(12) United States Patent
Shirakata et al.

(10) Patent No.: US 9,223,246 B2
(45) Date of Patent: Dec. 29, 2015

(54) IMAGE FORMING APPARATUS AND METHOD FOR CONTROLLING IMAGE FORMING APPARATUS

(71) Applicant: CANON KABUSHIKI KAISHA, Tokyo (JP)

(72) Inventors: Jiro Shirakata, Chigasaki (JP); Shuusuke Miura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/515,942

(22) Filed: Oct. 16, 2014

(65) Prior Publication Data

US 2015/0168867 A1 Jun. 18, 2015

(30) Foreign Application Priority Data

Dec. 17, 2013 (JP) ..... 2013-260382

(51) Int. Cl.
*G03G 15/08* (2006.01)
*G03G 15/00* (2006.01)

(52) U.S. Cl.
CPC ..... *G03G 15/0824* (2013.01); *G03G 15/0856* (2013.01); *G03G 15/0877* (2013.01); *G03G 15/556* (2013.01); *G03G 2215/0888* (2013.01)

(58) Field of Classification Search
CPC ..... G03G 15/0824; G03G 15/0829; G03G 15/0849; G03G 15/0853
See application file for complete search history.

(56) References Cited

U.S. PATENT DOCUMENTS

| | | | | |
|---|---|---|---|---|
| 6,917,780 | B2 * | 7/2005 | Ozawa et al. | 399/282 |
| 7,147,025 | B2 * | 12/2006 | Kitora | 152/415 |
| 8,032,042 | B2 * | 10/2011 | Fujii | 399/55 |
| 2009/0010659 | A1 | 1/2009 | Watanabe | |
| 2009/0060533 | A1 | 3/2009 | Yamaguchi | |
| 2009/0232524 | A1 | 9/2009 | Takahashi | |
| 2009/0310995 | A1 | 12/2009 | Nakayama | |
| 2013/0202319 | A1 | 8/2013 | Komatsu | |

FOREIGN PATENT DOCUMENTS

| | | | |
|---|---|---|---|
| JP | H04-304486 | A | 10/1992 |
| JP | 2006-091300 | A | 4/2006 |

* cited by examiner

*Primary Examiner* — Gregory H Curran
(74) *Attorney, Agent, or Firm* — Canon USA Inc. IP Division

(57) ABSTRACT

An image forming apparatus comprising: an image forming unit including a containing unit; a replenishment unit replenishes the containing unit with the toner; a first determination unit determines an amount of the toner consumed in the containing unit; a detection unit detects a toner amount in the containing unit; a first calculation unit calculates a difference between the toner amount and a target amount; a second calculation unit calculates a cumulative value of the difference; a second determination unit determines a determination value; a prevention unit prevents the second calculation unit from accumulating the difference at second timing following the first timing; and a controller controls the replenishment unit, based on the determination value, in a case where the first determination value is less than a threshold, the second calculating unit is prevented from accumulating the difference at the second timing, on the cumulative value calculated at the first timing.

18 Claims, 8 Drawing Sheets

IMAGE FORMING APPARATUS AND METHOD FOR CONTROLLING IMAGE FORMING APPARATUS

BACKGROUND OF THE INVENTION

1. Field of the Invention

The present invention relates to toner replenishment control for replenishing a containing unit with toner.

2. Description of the Related Art

There are image forming apparatuses that employ an electrophotographic method. This type of image forming apparatus forms a toner image based on image data input into the image forming apparatus, by consuming toner in a developer contained in a containing unit. It is known that, in this type of image forming apparatus, the density of the image formed by the image forming apparatus varies according to a ratio of the toner to the developer contained in the containing unit.

In this connection, one type of conventional image forming apparatuses predicts an amount of toner (a toner consumption amount) to be consumed in a containing unit due to formation of a toner image based on image data, and determines a toner replenishment amount so that a ratio of the toner in the containing unit becomes equal to a target value. Here, the toner consumption amount is theoretically obtained by calculation. Therefore, in reality, there is a slight error between a consumption amount of the toner actually consumed in the containing unit and the determined toner replenishment amount. In other words, the ratio of the toner in the containing unit may not become equal to the target value, even if toner is replenished based on the determined amount.

Japanese Patent Application Laid-Open No. 4-304486 discusses an image forming apparatus that corrects a toner replenishment amount according to a toner consumption amount, by using a correction amount calculated based on a ratio of toner in a containing unit.

In the image forming apparatus discussed in Japanese Patent Application Laid-Open No. 4-304486, images each consuming a large amount of toner may be formed, after images each consuming a small amount of toner are formed, when the ratio of the toner in the containing unit is higher than a target value. In this case, the containing unit is not immediately replenished with the toner, which is a problem.

When the images each consuming a small amount of toner are formed in the case where the ratio of the toner in the containing unit is higher than the target value, the correction amount serves to suppress the toner replenishment amount. In other words, the correction amount is a negative value, when the ratio of the toner in the containing unit is higher than the target value.

Therefore, when the image consuming a large amount of toner is formed after the images each consuming a small amount of toner are formed, the toner replenishment amount becomes a value equal to or below 0. The toner replenishment amount is calculated based on the toner consumption amount predicted according to the image consuming a large amount of toner and the correction amount. Therefore, the containing unit is prevented from being replenished with the toner, even when formation of the image consuming a large amount of toner has commenced and the toner in the containing unit has started to decrease.

SUMMARY OF THE INVENTION

According to an aspect of the present invention, an image forming apparatus comprising: an image forming unit including a containing unit that contains toner, and configured to form an image based on image data, by using the toner contained in the containing unit; a replenishment unit configured to replenish the containing unit with the toner; a first determination unit configured to determined, based on the image data, an amount of the toner consumed in the containing unit; a detection unit configured to detect an amount of the toner contained in the containing unit; a first calculation unit configured to calculate a difference between the amount of the toner detected by the detection unit and a target amount; a second calculation unit configured to calculate a cumulative value of the difference calculated by the first calculation unit; and a second determination unit configured to determine a determination value used for determining whether the replenishment unit replenishes the toner to the containing unit, based on the consumption amount determined by the first determination unit, the difference calculated by the first calculation unit, and the cumulative value calculated by the second calculation unit; a controller configured to control the replenishment unit, based on the determination value determined by the second determination unit, wherein in a case where the determination value determined by the second determination unit at a first timing is less than a threshold, the second calculating unit is prevented from accumulating the difference calculated by the first calculating unit at a second timing following the first timing, on the cumulative value calculated at the first timing.

According to another aspect of the present invention, a method for controlling an image forming apparatus that includes, an image forming unit including a containing unit that contains toner and configured to form an image based on image data by using the toner contained in the containing unit, a replenishment unit configured to replenish the containing unit with the toner, and a detection unit configured to detect an amount of the toner contained in the containing unit, the method comprising: detecting, based on the image data, an amount of the toner consumed in the containing unit; calculating a difference between the amount of the toner detected by the detection unit and a target amount; updating a cumulative value of the difference; determining, based on the consumption amount, the difference, and the cumulative value, a determination value used for determining whether the replenishment unit replenishes to the containing unit with the toner; and controlling the replenishment unit based on the determination value, wherein in the updating, the difference is accumulated to the cumulative value in a case where the determination value is above a threshold, whereas the difference is prevented from being accumulated on the cumulative value in a case where the determination value is less than the threshold.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Image Forming Apparatus

Figure 1:
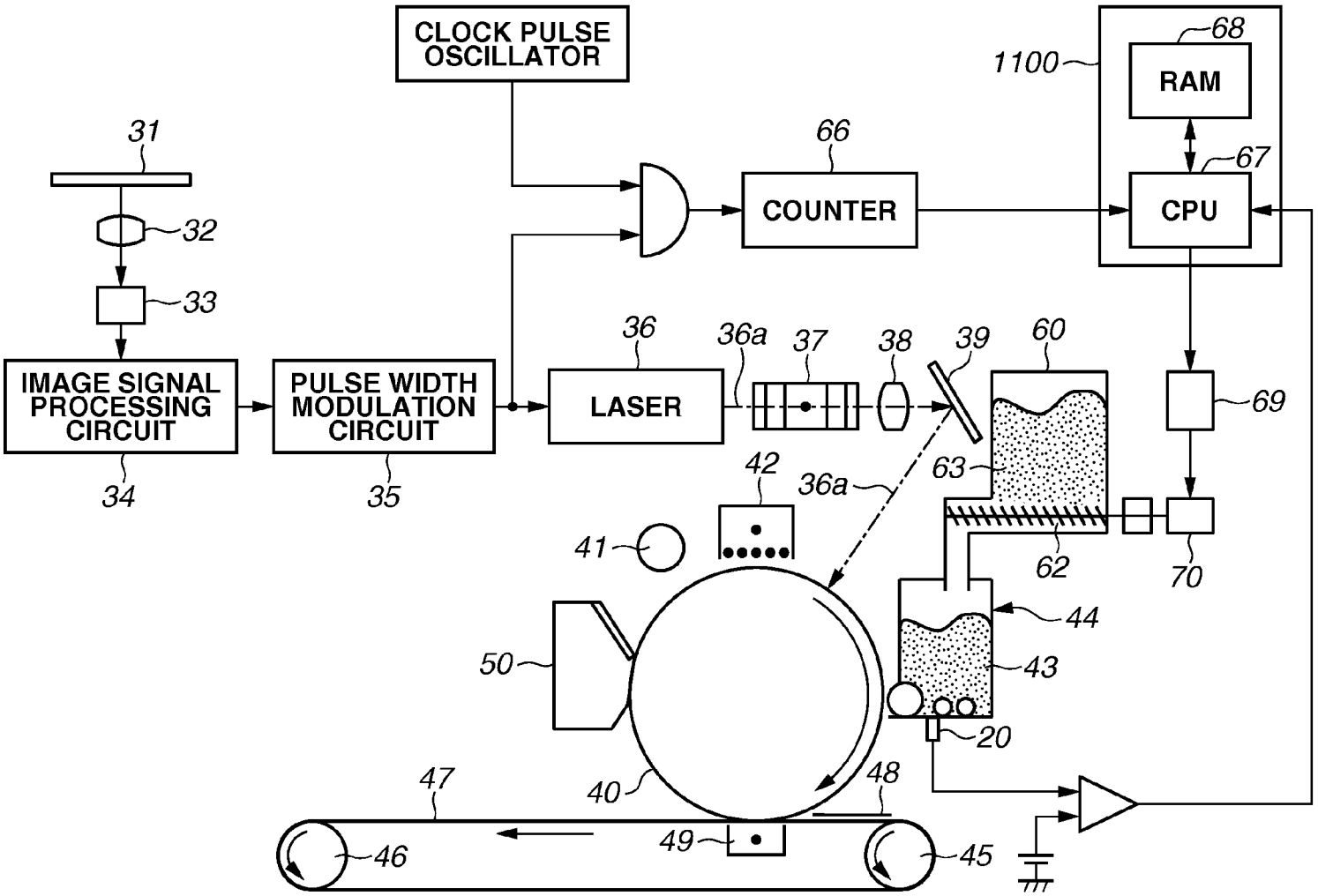
FIG. 1 is a schematic structural diagram of an image forming apparatus.

FIG. 1 is a schematic structural diagram of an image forming apparatus. In FIG. 1, an image of a document 31 is projected onto an imaging sensor 33 such as a charge-coupled device (CCD), through a lens 32. This imaging sensor 33 generates an analog image signal corresponding to the density of the image of the document 31. The analog image signal output from the imaging sensor 33 is sent to an image signal processing circuit 34 that converts the analog image signal to a digital image signal having an output level corresponding to the density of each pixel. The digital image signal is then sent to a pulse width modulation circuit 35.

Based on the input digital image signal, the pulse width modulation circuit 35 outputs a pulse signal of a time width (a duration) according to the density of each pixel. The pulse signal output from the pulse width modulation circuit 35 is supplied to a semiconductor laser 36. The semiconductor laser 36 emits a laser beam 36*a* based on the time width of the pulse signal.

The laser beam 36*a* emitted from the semiconductor laser 36 is deflected by a rotating polygon mirror 37, and then applied onto a photosensitive drum 40 through a lens such as a f/θ lens and by a mirror 39. The photosensitive drum 40 is driven to rotate in an arrow direction in FIG. 1. The laser beam 36*a* deflected by the rotating polygon mirror 37 scans in a direction (a main scanning direction) parallel to a rotation shaft of the photosensitive drum 40, due to rotation of the rotating polygon mirror 37.

The photosensitive drum 40 is subjected to static elimination by a static eliminating unit 41, and then uniformly charged by a charging unit 42. An exposure device includes the semiconductor laser 36, the rotating polygon mirror 37, the lens 38, and the mirror 39. This exposure device exposes the photosensitive drum 40 with the laser beam 36*a* modulated according to the digital image signal, so that an electrostatic latent image corresponding to the digital image signal is formed on the photosensitive drum 40. A developing unit 44 is a containing unit that contains a two-component developer 43 including toner 63 and a carrier. Using the toner 63, the developing unit 44 develops the electrostatic latent image formed on the photosensitive drum 40, so that a toner image is formed. A recording-material carrying belt 47 is held by two rollers 45 and 46, to carry and convey a recording material 48 in an arrow direction in FIG. 1. A transfer charging unit 49 transfers the toner image formed on the photosensitive drum 40, to the recording material 48 carried by the recording-material carrying belt 47.

The recording material 48, to which the toner image has been transferred, is separated from the recording-material carrying belt 47 and then conveyed to a fixing unit that is not illustrated. The fixing unit includes a heating roller having a heater and a pressure roller pressing the heating roller. Heat and pressure are applied to the recording material 48 on which the toner image has been formed. As a result, the toner image formed on the recording material 48 is fixed thereto. A drum cleaner 50 removes residual toner on the photosensitive drum 40, after the toner image on the photosensitive drum 40 is transferred to the recording material 48.

The image forming apparatus has been described in which one image forming station includes the photosensitive drum 40, the static eliminating unit 41, the charging unit 42, the developing unit 44, the transfer charging unit 49, and the drum cleaner 50. However, an image forming apparatus including two or more image forming stations may be employed. For example, a full-color image forming apparatus may be employed. The full-color image forming apparatus includes four image forming stations for cyan, magenta, yellow, and black, which are arranged along a conveyance direction of the recording-material carrying belt 47. In this configuration, an image of a document is separated into colors of cyan, magenta, yellow, and black, and a toner image of a color component corresponding to each of the image forming stations is formed on the photosensitive drum 40. The toner images of the respective color components on the respective image forming stations are sequentially transferred to the recording material 48 carried by the recording-material carrying belt 47, so that a full-color toner image is formed.

Figure 2:
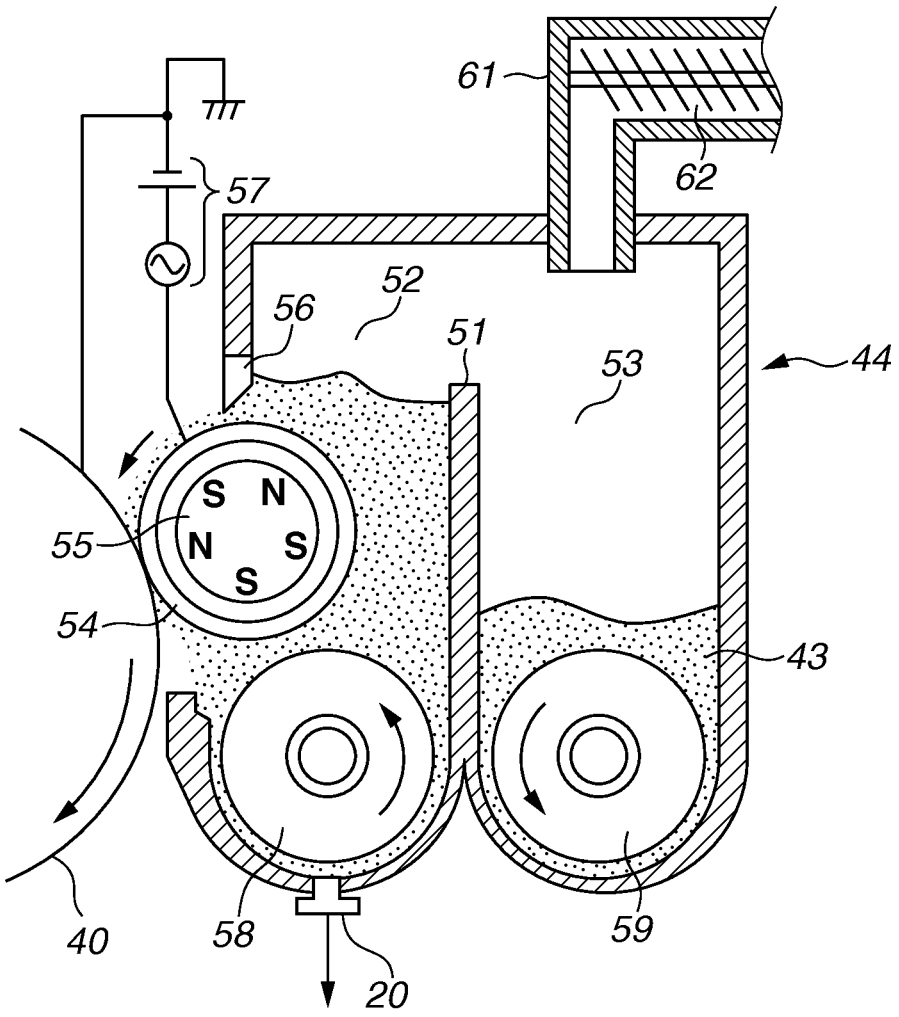
FIG. 2 is an essential-part schematic diagram of a developing unit provided in the image forming apparatus.

FIG. 2 is an essential-part schematic diagram of the developing unit 44. The developing unit 44 is disposed to face the photosensitive drum 40. A partition 51 partitions the inside of the developing unit 44 into a developing chamber 52 and a agitating chamber 53. In the developing chamber 52, a non-magnetic developing sleeve 54 is disposed to rotate in an arrow direction, and a magnet 55 is fixed inside this developing sleeve 54.

A developer 43 is carried by the developing sleeve 54, and regulated by a regulating blade 56 in terms of layer thickness. The developer 43 carried by the developing sleeve 54 is supplied to the photosensitive drum 40, in passing through a developing region facing the photosensitive drum 40, as the developing sleeve 54 rotates in the arrow direction. As a result, the electrostatic latent image on the photosensitive drum 40 is developed. A power supply 57 applies, to the developing sleeve 54, a developing bias voltage in which an alternating current (AC) voltage is superimposed on a direct current (DC) voltage.

A agitating screw 58 stirs and conveys the developer 43 in the developing chamber 52. Further, a agitating screw 59 stirs the toner 63 and the developer 43, so that a toner-to-developer ratio (hereinafter referred to as "toner density") becomes uniform. The toner 63 is supplied from a toner discharge port 61 of a hopper 60 (FIG. 1) by rotation of a conveyance screw 62. The developer 43 is contained in the agitating chamber 53. A developer passage that is not illustrated is formed in the partition 51. The developer passage connects the developing chamber 52 with the agitating chamber 53. Therefore, the developer 43 contained in the developing chamber 52 and the agitating chamber 53 circulates in the developing unit 44 due to the rotation of the agitating screws 58 and 59.

An inductance sensor 20 is disposed in a bottom wall of the developing chamber 52. The inductance sensor detects the amount of the toner 63 contained in the developing unit 44. Specifically, the inductance sensor 20 detects a permeability of the developer 43 contained in the developing chamber 52, and outputs a signal according to the toner-to-developer ratio. A central processing unit (CPU) 67 detects the amount of the toner 63 in the developer 43, based on the output signal of the inductance sensor 20.

The developer 43 contained in the developing chamber 52 includes the toner 63 and the carrier having magnetic properties. Therefore, when the toner density of the developing unit increases, the carrier-to-developer ratio decreases and thus, an output value of the inductance sensor 20 decreases. On the other hand, when the toner density of the developing unit decreases, the carrier-to-developer ratio increases and thus, the output value of the inductance sensor 20 increases. In other words, the inductance sensor 20 detects the ratio of the toner 63 to the developer 43 stored in the developing chamber 52, and outputs a signal according to this ratio to a controller 1100 (FIG. 3).

In the present exemplary embodiment, a toner replenishment amount is determined based on a toner consumption amount and the toner density of the developing unit. The toner 63 consumption amount is an amount consumed in the developing unit 44 due to formation of the toner image based on the image data by the image forming station. The toner density of the developing unit 44 is detected by the inductance sensor 20. Toner replenishment control for determining the toner replenishment amount will be described below.

Figure 3:
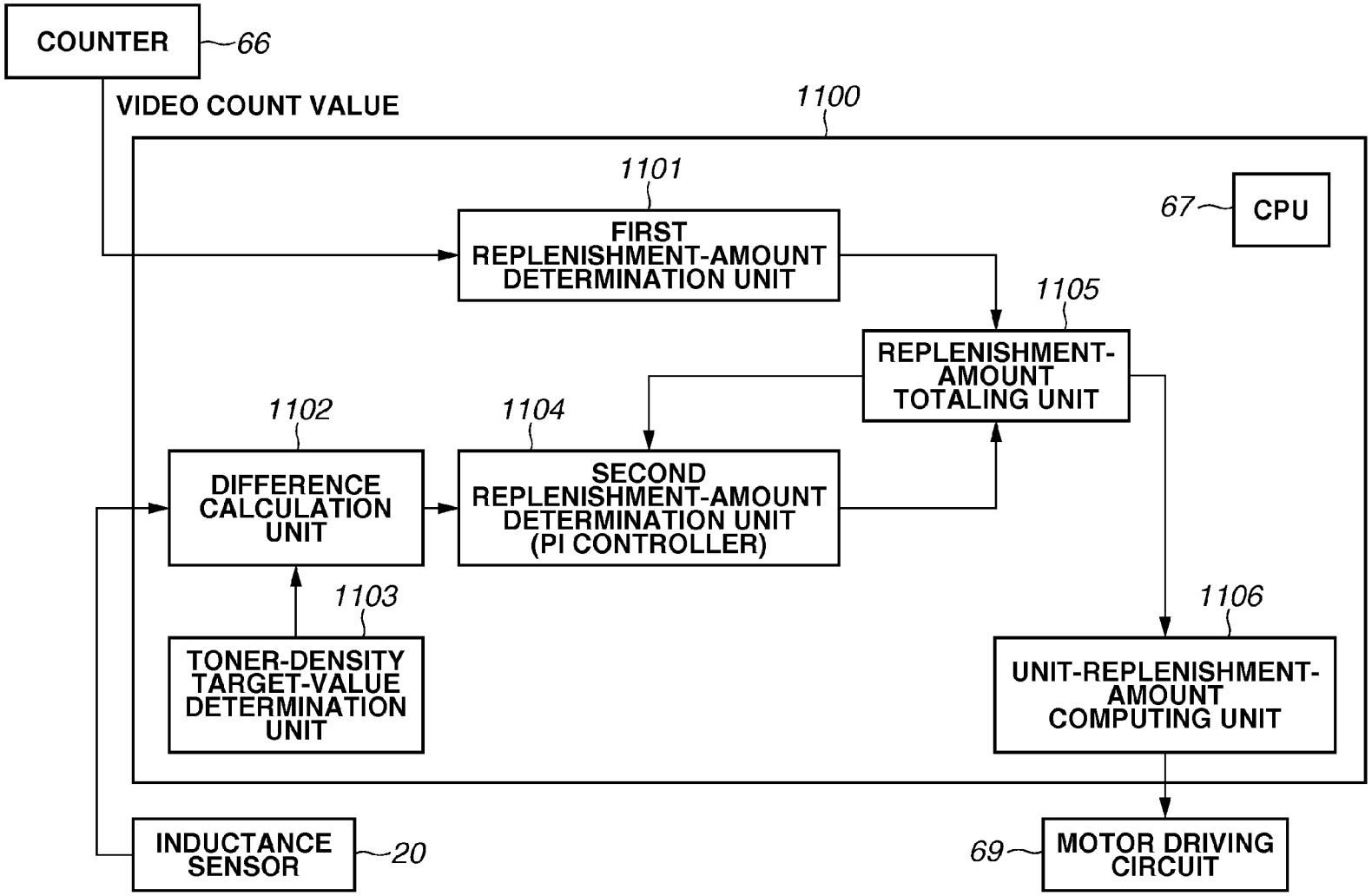
FIG. 3 is a block diagram illustrating an electrical configuration according to toner replenishment of the image forming apparatus.

FIG. 3 is a block diagram illustrating an electrical configuration according to toner replenishment of the image forming apparatus. The CPU 67 is a circuit that controls each part so as to control toner replenishment. The inductance sensor 20 has been described with reference to FIG. 2, and therefore will not be described here. A motor driving circuit 69 controls a motor 70 that rotates the conveyance screw 62.

A counter 66 counts to obtain the sum of the densities of the respective pixels included in an image for one page, based on the digital image signal output from the image signal processing circuit 34. The sum (hereinafter referred to as "video count value") of the densities of the respective pixels obtained by the counter 66 is equivalent to the amount of the toner 63 consumed in the developing unit 44 due to formation of a toner image for one page included in the image data. A method of acquiring the video count value is a known technique and therefore will not be described here.

In the present exemplary embodiment, the controller 1100 determines the amount of the toner 63 used for replenishing the developing unit 44, based on the value output by the inductance sensor 20 and the video count value acquired by the counter 66. Further, until a cumulative value of the replenishment amount determined by the controller 1100 becomes smaller than a predetermined value, the motor driving circuit 69 rotates the conveyance screw 62, so that the developing unit 44 is replenished with the toner 63 in the hopper 60 (FIG. 1).

Toner Replenishment Control

Figure 4:
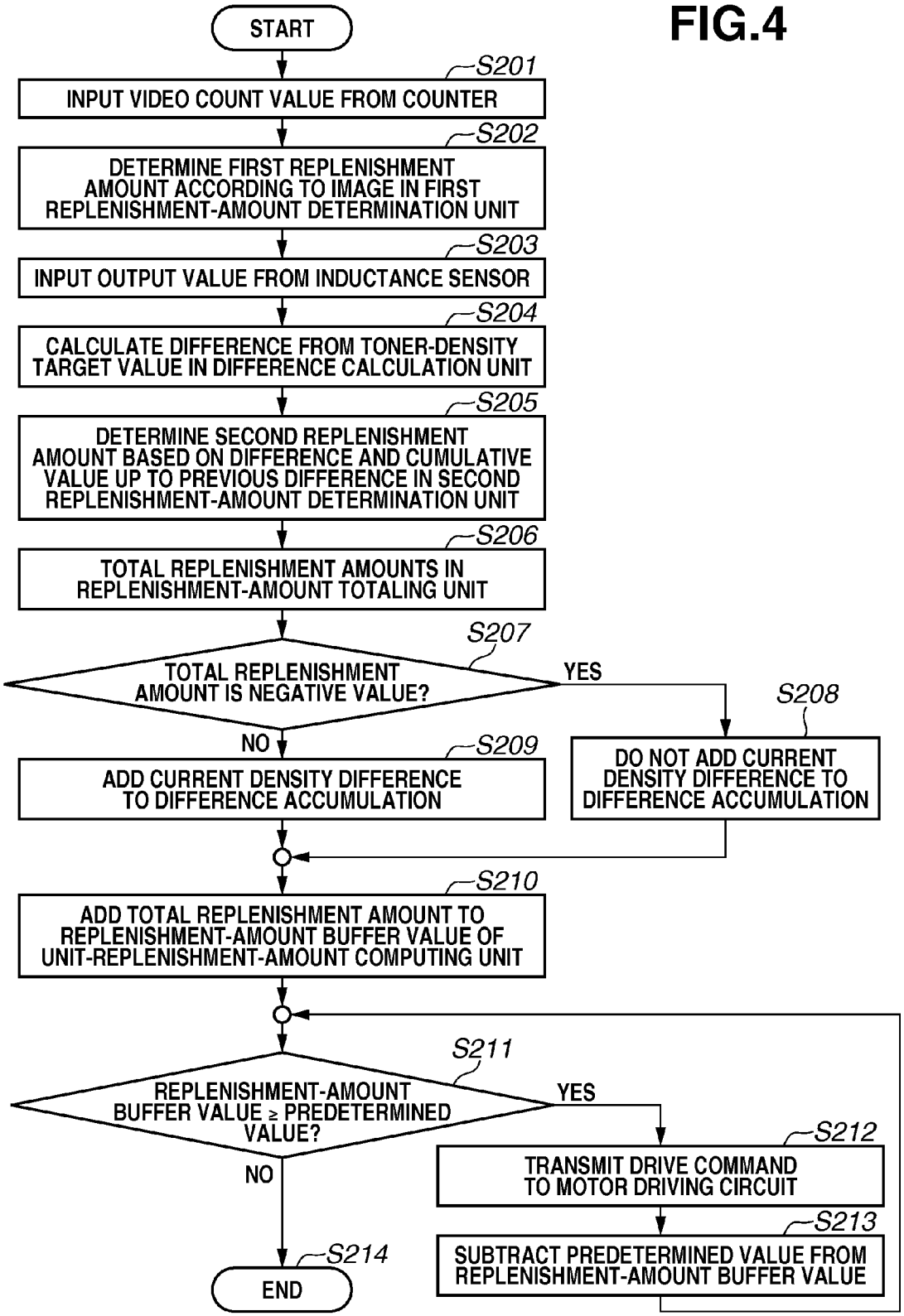
FIG. 4 is a flowchart illustrating toner replenishment control.

The toner replenishment control of the exemplary embodiment will be described below with reference to FIG. 4. FIG. 4 is a flowchart illustrating operation of the CPU 67.

The CPU 67 starts the toner replenishment control in response to transfer of image data through an interface that is not illustrated. In step S201, the video count value is input from the counter 66. In step S202, a first replenishment-amount determination unit 1101 determines a first replenishment amount based on the video count value, by referring to a conversion table indicating a correspondence between the video count value and the toner replenishment amount.

In step S201, the counter 66 acquires the video count value per page, from a toner image of at least one or more pages included in the image data. Subsequently, at the timing that the image forming station starts forming the toner image of each page, the counter 66 outputs the video count value of the corresponding page to the controller 1100. In other words, the counter 66 outputs the video count value corresponding to the toner image for one page to be formed by the image forming station, to the controller 1100.

In step S203, the controller 1100 receives an output value D1 of the inductance sensor 20, before the toner image for one page is formed. In step S204, a difference calculation unit 1102 computes a difference ΔD1 between the output value D1 of the inductance sensor 20 and a target value D1ref output from a toner-density target-value determination unit 1103.

Here, when a toner image of an nth page is formed, the difference between an output value Dn of the inductance sensor 20 and a target value Dnref is computed by an expression (1).

$$\Delta Dn = Dn - Dn\text{ref (where "}n\text{" is the number of pages)} \quad (1)$$

The toner-density target-value determination unit 1103 determines the target value Dnref, based on temperature and humidity around the image forming apparatus detected by an environment sensor (not illustrated) provided in the image forming apparatus.

In step S205, a second replenishment-amount determination unit 1104 determines a second replenishment amount, based on the difference ΔDn at the timing that the image of the nth page is formed and a cumulative value $\Sigma\Delta D_{n-1}$ to be described below. In the present exemplary embodiment, for example, the second replenishment-amount determination unit 1104 determines the second replenishment amount based on an expression (2).

$$\text{Second replenishment amount} = (\alpha \times \Delta Dn) + (\beta \times \Sigma\Delta D_{n-1}) \quad (2)$$

Constants α and β each are a gain value determined beforehand by an experiment. In the present exemplary embodiment, the constants α and β each are a positive value smaller than 1.

The cumulative value $\Sigma\Delta D_{n-1}$ is computed based on the output value received from the inductance sensor 20 each time the toner image for one page is formed, and the target value output by the toner-density target-value determination unit 1103. This cumulative value $\Sigma\Delta D_{n-1}$ is determined in step S208 or S209 to be described below.

Next, in step S206, a replenishment-amount totaling unit 1105 determines a total replenishment amount, by computing the sum of the first replenishment amount and the second replenishment amount. This total replenishment amount will be added to a replenishment-amount buffer value in step S210 to be described below. If the replenishment-amount buffer value is equal to or above a predetermined value, the conveyance screw 62 starts operation for replenishing the developing unit 44 with the toner 63 from the hopper 60.

Here, when an image using an extremely small amount of toner is formed in a case where the toner density of the developing unit is higher than the target value, the second replenishment amount becomes a negative value, and the total replenishment amount also becomes a negative value. When images each using an extremely small amount of toner are successively formed, the total replenishment amount that is a negative value is added to the replenishment-amount buffer value for each page. Therefore, the replenishment-amount buffer value becomes a negative value. Assume that an image using an extremely large amount of toner is formed after the images that each use an extremely small amount of toner are successively formed. In this case, a problem arises. That is, although the total replenishment amount is a positive value, the replenishment is not started because the replenishment-amount buffer value is not equal to or above the predetermined value.

Therefore, in the present exemplary embodiment, a decrease in the replenishment-amount buffer value is suppressed, when an image using an extremely small amount of toner is formed in the case where the toner density of the developing unit is higher than the target value.

In step S207, after the total replenishment amount is determined in step S206, the CPU 67 determines whether the total replenishment amount is a negative value. In step S208, when it is determined that the total replenishment amount is a negative value (Yes in step S207), the second replenishment-amount determination unit 1104 maintains the cumulative value without adding the difference ΔDn to the cumulative value $\Sigma\Delta D_{n-1}$. In other words, in step S208, the second replenishment-amount determination unit 1104 sets the cumulative value $\Sigma\Delta D_{n-1}$ as a cumulative value ΣΔDn.

In step S208, the CPU 67 does not perform difference accumulation. Therefore, even when an image using an extremely small amount of toner is formed in the case where the toner density of the developing unit is higher than the target value, a decrease in the replenishment-amount buffer value can be suppressed.

On the other hand, in step S209, when it is determined that the total replenishment amount is not a negative value (No in step S207), the second replenishment-amount determination unit 1104 adds the difference ΔDn to the cumulative value $\Sigma\Delta D_{n-1}$. In other words, in step S209, the second replenishment-amount determination unit 1104 sets the sum of the cumulative value $\Sigma\Delta D_{n-1}$ and the difference ΔDn, as the cumulative value ΣΔDn.

In step S207, the total replenishment amount functions as a value for determining whether to perform updating by adding the difference ΔDn computed at first timing to the cumulative value $\Sigma\Delta D_{n-1}$ computed at the first timing, or to perform updating without such addition. In step S210, after the cumulative value ΣΔDn is set by the second replenishment-amount determination unit 1104 in step S208 or S209, a unit-replenishment-amount computing unit 1106 adds the total replenishment amount to the replenishment-amount buffer value. The cumulative value ΣΔDn is used in computation for determining the total replenishment amount when the next toner replenishment control is performed. Timing that the next toner replenishment control is performed corresponds to second timing that follows the first timing.

In step S211, the CPU 67 determines whether the replenishment-amount buffer value computed in step S210 is equal to or above the predetermined value. In step S211, the predetermined value is, for example, the amount of the toner 63 used for replenishment by one rotation of the conveyance screw 62. The predetermined value is determined beforehand, based on the amount of the toner 63 used for replenishing the developing unit 44 from the hopper 60 in one replenishment. The predetermined value is stored beforehand in, for example, a read-only memory (ROM) that is not illustrated.

In step S212, when it is determined that the replenishment-amount buffer value is equal to or above the predetermined value (Yes in step S211), the CPU 67 transmits a drive command to the motor driving circuit 69. When the drive command is received, the motor driving circuit 69 drives the motor 70 to cause one rotation of the conveyance screw 62. As a result, the conveyance screw 62 supplies the toner 63 from the hopper 60 to the developing unit 44.

Next, in step S213, the CPU 67 subtracts the predetermined value from the replenishment-amount buffer value and then returns to step S211. In other words, in the processing from step S211 to step S213, the CPU 67 keeps supplying the toner 63 from the hopper 60 to the developing unit 44, until the replenishment-amount buffer value falls below the predetermined value.

When the CPU 67 determines that the replenishment-amount buffer value is below the predetermined value (No in step S211), the CPU 67 ends the toner replenishment control.

Comparative Example 1

Figure 5:
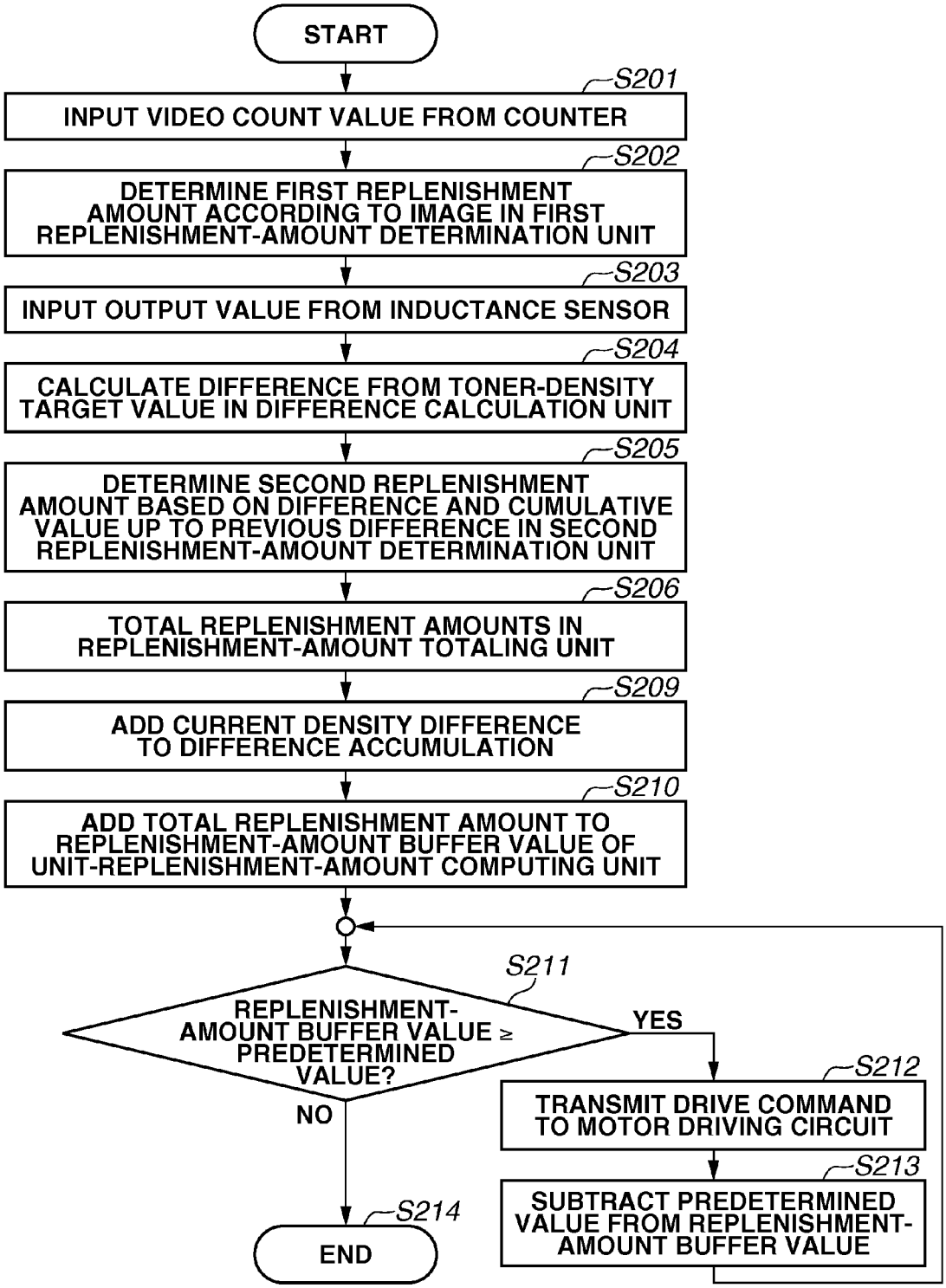
FIG. 5 is a flowchart illustrating toner replenishment control according to comparative example 1.

Here, conventional toner replenishment control (PI control) will be described with reference to a flowchart in FIG. 5. As illustrated in FIG. 5, processing from step S201 to step S206 is similar to that in the present exemplary embodiment and therefore will not be described in detail here.

After computing a total replenishment amount in step S206, the CPU 67 proceeds to step S209 where the second replenishment amount determination unit 1104 adds a difference ΔDn to a cumulative value $\Sigma\Delta D_{n-1}$. Processing in or after step S210 is similar to that in the present exemplary embodiment and therefore will not be described in detail here.

Comparative Example 2

Figure 6:
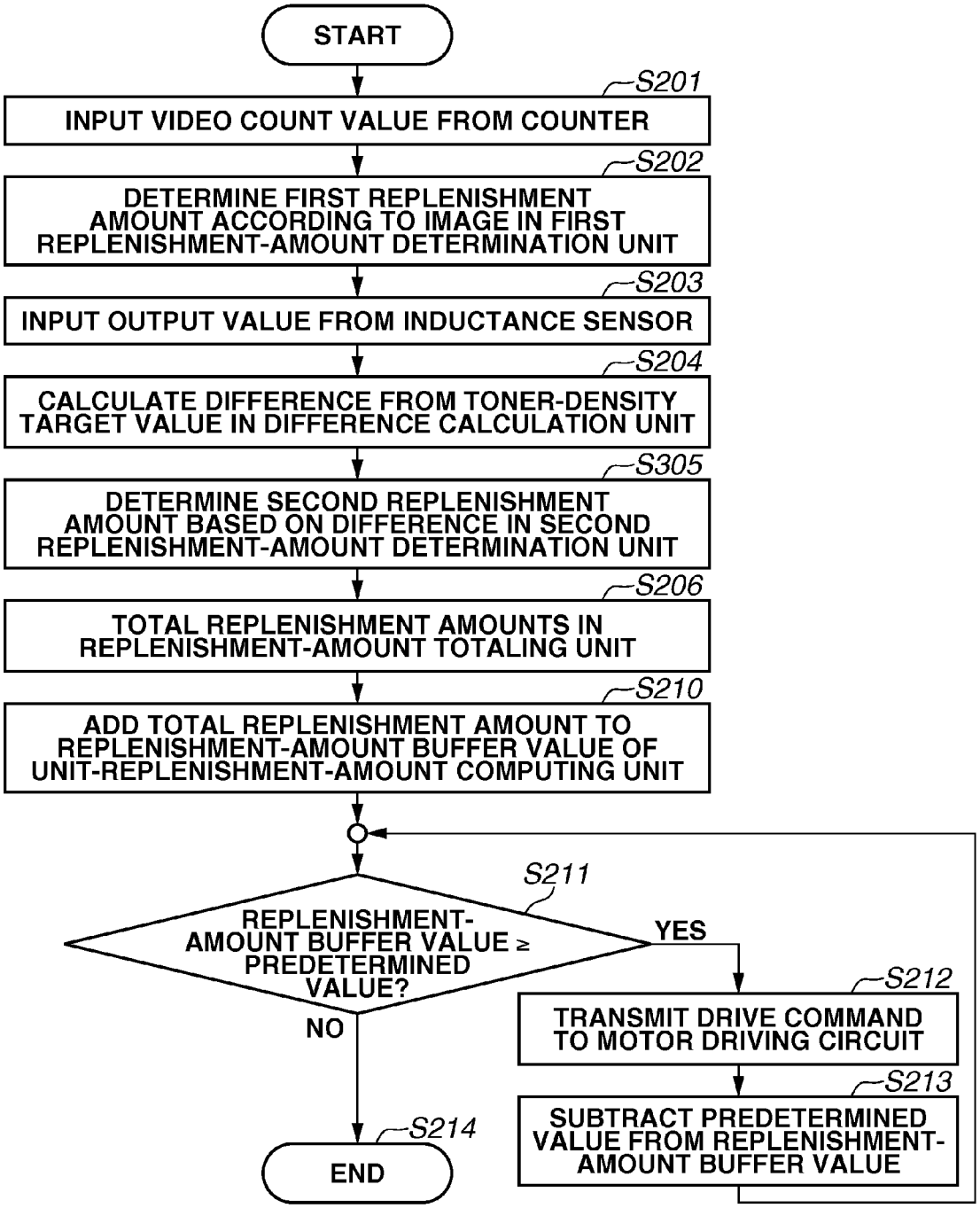
FIG. 6 is a flowchart illustrating toner replenishment control according to comparative example 2.

Another conventional toner replenishment control (P control) different from comparative example 1 will be described with reference to a flowchart in FIG. 6. As illustrated in FIG. 6, processing from step S201 to step S204 is similar to that in the present exemplary embodiment and therefore will not be described in detail here.

After the difference calculation unit 1102 computes a difference ΔDn between an output value Dn of the inductance sensor 20 and a target value Dnref in step S204, the CPU 67 proceeds to step S305. In step S305, the CPU 67 determines a second replenishment amount by multiplying the difference ΔDn by a predetermined gain "α". Next, in step S206, the CPU 67 computes the sum of a first replenishment amount and the second replenishment amount, and then proceeds to step S210. Processing in or after step S210 is similar to that in the present exemplary embodiment and therefore will not be described in detail here.

Comparison of Effects

Figure 7A:
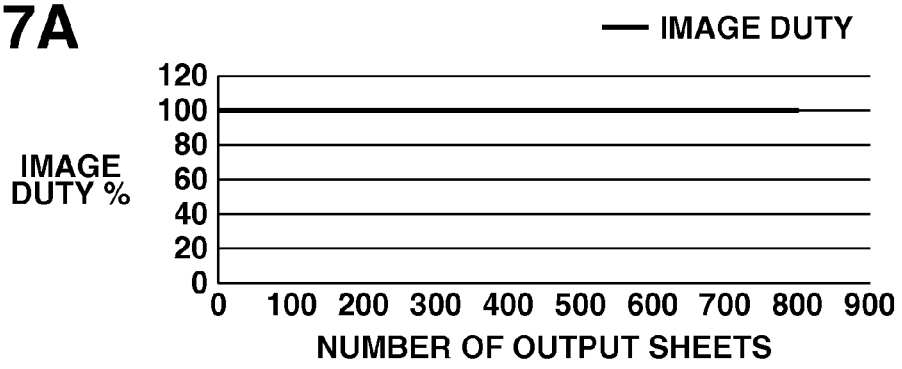
FIGS. 7A, 7B, and 7C are transition diagrams each illustrating each parameter at the time when solid images are successively formed.
Figure 7B:
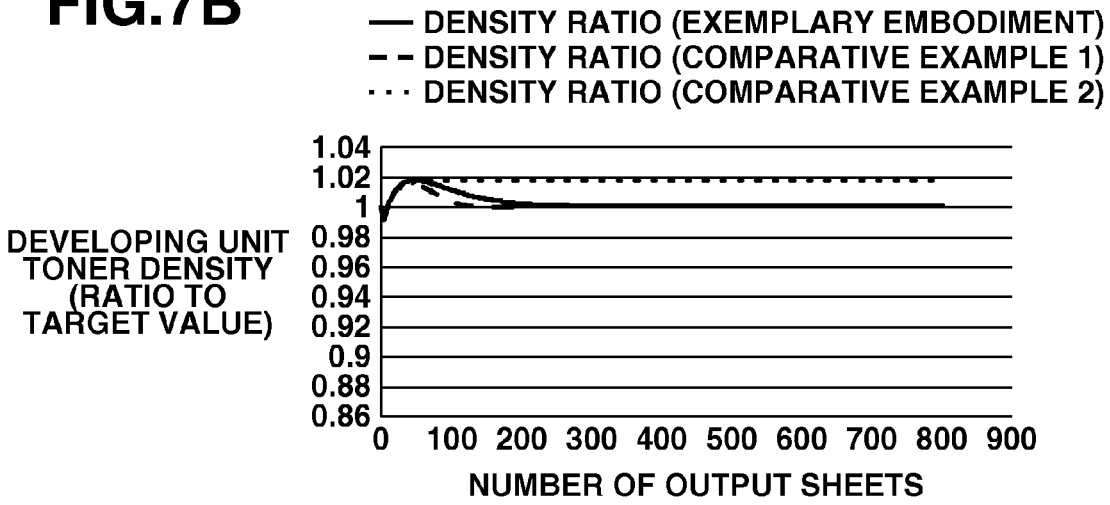
Figure 7C:
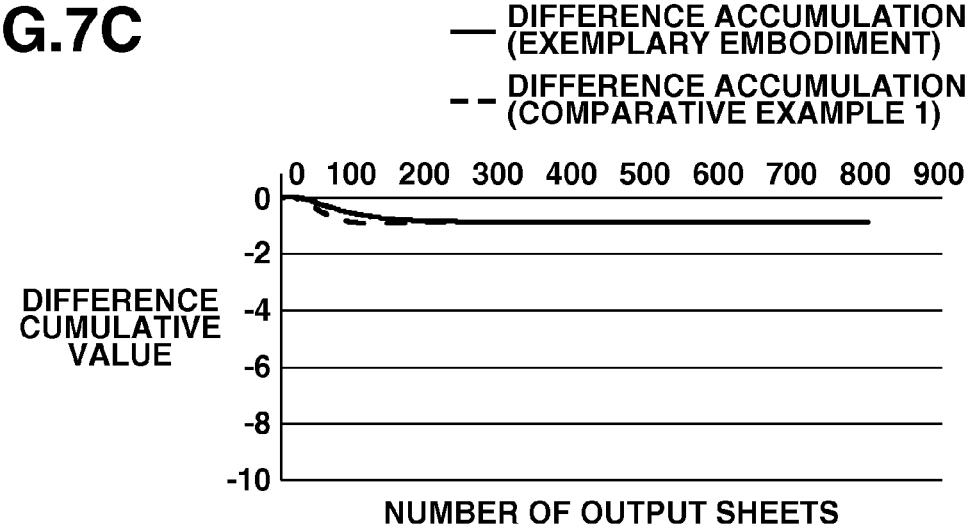

Effects in the toner replenishment control of the present exemplary embodiment will be compared with those of the comparative examples 1 and 2, and results will be described below. FIGS. 7A to 7C are provided to describe transition in the ratio between the toner density of the developing unit and the target value, and transition in the cumulative value, at the time when toner images of 100% image duty are successively formed. In FIGS. 7A to 7C, a solid line indicates results of the toner replenishment control in the present exemplary embodiment. Further, a long dashed line indicates results of the toner replenishment control in comparative example 1, and a short dashed line indicates results of the toner replenishment control in comparative example 2.

FIG. 7A indicates the case where the images of 100% image duty are formed successively. The image duty is an area ratio of a toner-adhered region in one page of the recording material. In other words, when a toner image is formed on the entire surface of one page of the recording material, the image duty is 100%. When no toner image is formed in one page of the recording material, the image duty is 0%. Further, a toner image of 100% image duty is defined to have a density value of 1.6.

In FIG. 7B, a vertical axis (the toner density of the developing unit) indicates that the toner density of the developing unit is above the target value when a numerical value is larger than 1, and that the toner density of the developing unit is below the target value when the numerical value is smaller than 1. In FIG. 7C, a vertical axis indicates the cumulative value ΣΔDn obtained by adding the difference ΔDn between the output value Dn of the inductance sensor 20 and the target value Dnref, to the cumulative value $\Sigma\Delta D_{n-1}$ of up to previous difference.

When the image forming station keeps forming the toner images of 100% image duty, the toner density of the developing unit continues to rise from start of the toner-image formation, until the toner image of the 50th page is formed. This indicates that the amount of the toner 63 used for replenishment by one rotation of the conveyance screw 62 is larger than a replenishment amount predicted beforehand by an experiment. This is attributable to temperature or humidity around the image forming apparatus, or tolerance or individual difference of a mechanical component of the conveyance screw 62.

When there is a deviation in the toner replenishment amount as described above, a steady-state deviation of the toner density of the developing unit from the target value remains, in the toner replenishment control of comparative example 2. On the other hand, in the toner replenishment control of the present exemplary embodiment and comparative example 1, the second replenishment amount is corrected based on the cumulative value and therefore, the toner density of the developing unit converges at the target value.

Now, another case will be described with reference to FIGS. 8A to 8C. In this case, there is a period of allowing the recording material to pass without forming a toner image, during formation of the toner images of 100% image duty.

Figure 8A:
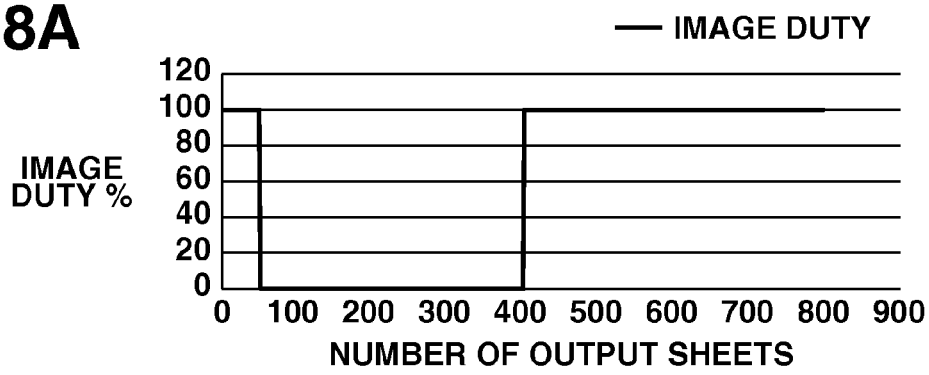
FIGS. 8A, 8B, and 8C are transition diagrams each illustrating each parameter at the time when a solid image and a blank image are alternately formed.
Figure 8B:
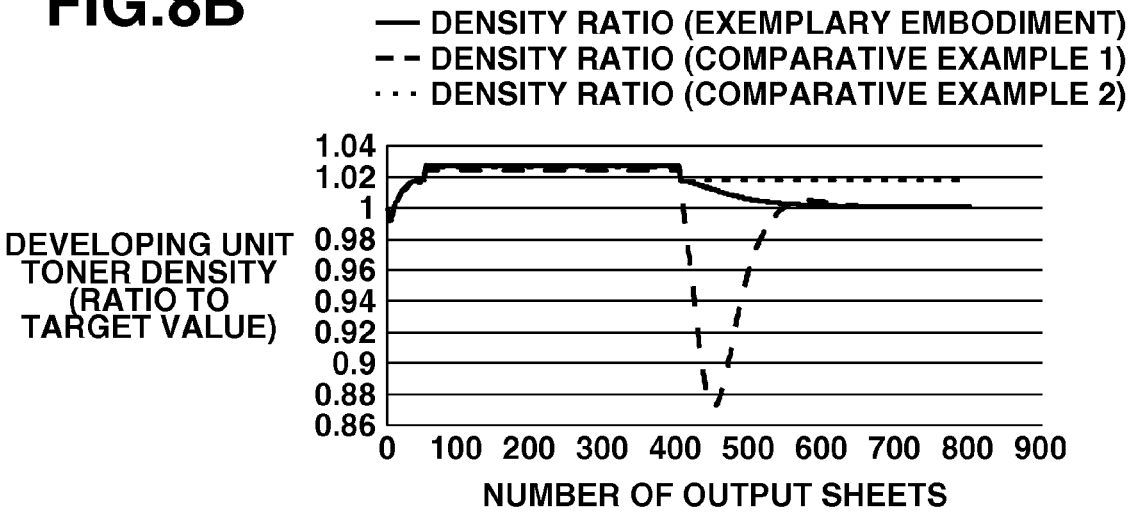
Figure 8C:
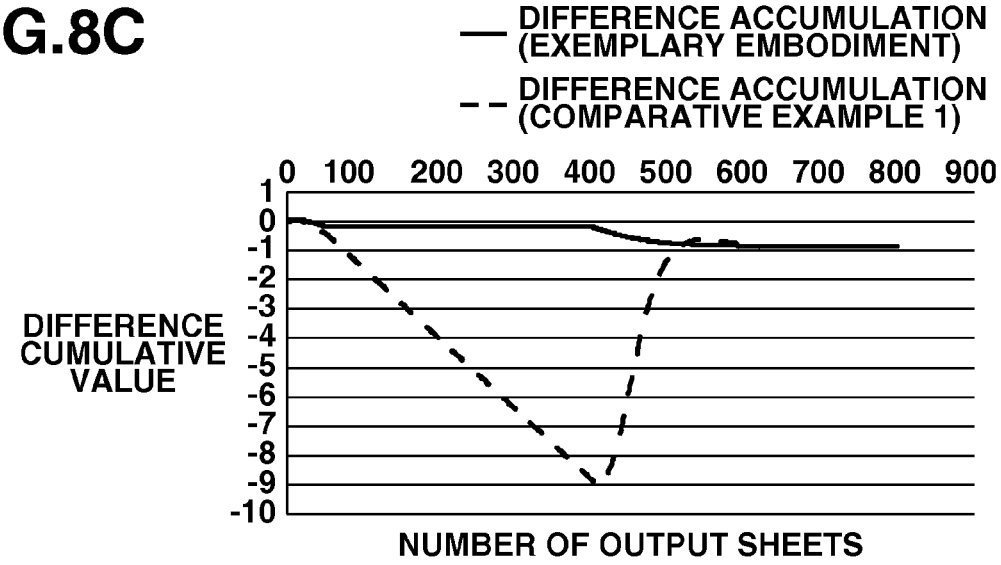

As illustrated in FIGS. 8A and 8B, the toner density of the developing unit rises relative to the target value, while the toner images of 100% image duty are formed for 50 pages. Subsequently, the image duty changes from 100% to 0% (FIG. 8A). However, despite this change, the toner density of the developing unit is maintained as illustrated in FIG. 8B. In a 0% image duty period in which no toner image is formed, the toner 63 in the developing unit 44 cannot be consumed and therefore, the toner density of the developing unit cannot be reduced.

Subsequently, when the image duty changes from 0% to 100% in or after the 400th pages, the toner 63 contained in the developing unit 44 is consumed to form the toner images. The toner density of the developing unit in the present exemplary embodiment starts decreasing in or after the 400th pages, and smoothly converges at the target value.

On the other hand, the toner density of the developing unit in comparative example 1 significantly decreases from the 400th page to the 450th page. This is because, as illustrated in FIG. 8C, the cumulative value is excessively accumulated in the period in which no toner image is formed from the 50th page to the 400th page. In other words, in the toner replenishment control of comparative example 1, even if the total replenishment amount becomes a value calling for immediate replenishment, the replenishment is not performed because the replenishment-amount buffer value does not become equal to or above the predetermined value.

In comparative example 2, the replenishment amount is not corrected based on the cumulative value. Therefore, the toner density of the developing unit does not significantly fall, as in the comparative example 1. However, the toner density of the developing unit cannot converge at the target value.

In the toner replenishment of the exemplary embodiment, the cumulative value is prevented from being excessively accumulated. Therefore, the toner density of the developing unit can converge at the target value, without having an overshoot as in comparative example 1.

In addition, in the present exemplary embodiment, the second replenishment-amount determination unit 1104 stops computing the cumulative value of the differences, if the total replenishment amount obtained in forming the toner image for the immediately preceding page is less than a threshold. However, any other configuration may be adopted as long as the second replenishment-amount determination unit 1104 is prevented from adding the difference to the cumulative value. For example, the second replenishment-amount determination unit 1104 may update the cumulative value by considering the value of the difference as "0", if the total replenishment amount obtained in forming the toner image for the immediately preceding page is less than the threshold.

Moreover, in the present exemplary embodiment, each time the image data is transferred to the controller 1100, the CPU 67 controls the toner replenishment. In this toner replenishment control, the tonner replenishment is performed if the replenishment-amount buffer value is equal to or above the predetermined value before the image forming station forms the toner image for one page of the recording material. However, the timing for controlling the toner replenishment is not limited to this configuration.

For example, the CPU 67 may perform the toner replenishment control in FIG. 4 at predetermined time intervals, while the agitating screws 58 and 59 in the developing unit 44 rotate. In this configuration, the developing unit 44 can be replenished with the toner 63 from the hopper 60, each time the toner density of the developing unit falls below the target value. Therefore, the density of the toner image formed by the image forming station can be further stabilized.

According to the toner replenishment control of the present exemplary embodiment, even if an image using a large amount of toner is formed after images each using a small amount of toner are successively formed, the toner replenishment amount for the developing unit 44 can be precisely controlled. In other words, when the image using a large amount of toner is formed after the images each using a small amount of toner are successively formed, the toner density of the developer contained in the developing unit 44 can converge at the target value. Therefore, it is possible to suppress a density change of an image formed by the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-260382 filed Dec. 17, 2013, which is hereby incorporated by reference herein in its entirety.

What is claimed is:

1. An image forming apparatus comprising:

an image forming unit including a containing unit that contains toner, and configured to form an image based on image data, by using the toner contained in the containing unit;

a replenishment unit configured to replenish the containing unit with the toner;

a first determination unit configured to determine, based on the image data, a consumption amount of the toner consumed in the containing unit in a case where the image forming unit forms the image based on the image data;

a detection unit configured to detect an amount of the toner contained in the containing unit;

a first calculation unit configured to calculate a difference between the amount of the toner detected by the detection unit and a target amount;

a second calculation unit configured to accumulate the difference calculated by the first calculation unit to calculate a cumulative value of the difference;

a second determination unit configured to determine a determination value used for determining whether the replenishment unit replenishes the containing unit with the toner, based on the consumption amount determined by the first determination unit, the difference calculated by the first calculation unit, and the cumulative value calculated by the second calculation unit;

a controller configured to control the replenishment unit, based on the determination value determined by the second determination unit; and a prevention unit configured to prevent, in a case where the determination value determined by the second determination unit at first timing is less than a threshold, the second calculation unit from accumulating the difference calculated by the first calculating unit at second timing following the first timing, on the cumulative value calculated at the first timing.

2. The image forming apparatus according to claim 1, wherein in a case where the determination value determined at the first timing is less than the threshold, the second calculation unit is prevented from performing accumulation calculation.

3. The image forming apparatus according to claim 1, wherein in a case where the determination value determined at the first timing is less than the threshold, the second calculation unit adds the difference calculated by the first calculation unit at the first timing to the cumulative value as 0.

4. The image forming apparatus according to claim 1, wherein the second determination unit updates the determination value, each time the image forming unit forms an image for one page of a recording material.

5. The image forming apparatus according to claim 1, wherein the containing unit contains a developer including the toner, wherein the containing unit includes a agitating unit configured to stir the developer contained in the containing unit, and wherein the second determination unit updates the determination value at predetermined time intervals, while the agitating unit stirs the developer.

6. The image forming apparatus according to claim 1, wherein the threshold is 0.

7. The image forming apparatus according to claim 1, wherein in a case where a cumulative value of the determination value determined by the second determination unit does not exceed a predetermined value, the controller prevents the replenishment unit from replenishing the containing unit with the toner.

8. The image forming apparatus according to claim 7, wherein the predetermined value corresponds to an amount of the toner with which the replenishment unit replenishes the containing unit in a case where the replenishment unit executes replenishment once.

9. The image forming apparatus according to claim 1, wherein the containing unit contains a developer including the toner, and wherein the detection unit outputs a signal according to a ratio of the toner to the developer contained in the containing unit.

10. A method for controlling an image forming apparatus that includes, an image forming unit including a containing unit that contains toner and configured to form an image based on image data by using the toner contained in the containing unit, a replenishment unit configured to replenish the containing unit with the toner, and a detection unit configured to detect an amount of the toner contained in the containing unit, the method comprising:

detecting, based on the image data, a consumption amount of the toner consumed in the containing unit in a case where the image forming unit forms the image based on the image data;

calculating a difference between the amount of the toner detected by the detection unit and a target amount;

updating a cumulative value of the difference;

determining, based on the consumption amount, the difference, and the cumulative value, a determination value used for determining whether to cause the replenishment unit to replenish by the containing unit; and controlling the replenishment unit based on the determination value, wherein in the updating, the difference is accumulated to the cumulative value in a case where the determination value is above a threshold, whereas the difference is prevented from being accumulated on the cumulative value in a case where the determination value is less than the threshold.

11. The method according to claim 10, wherein in the updating, calculation for accumulation of the difference to the cumulative value is not performed, in a case where the determination value is less than the threshold.

12. The method according to claim 10, wherein in the updating, the difference is added to the cumulative value as 0, in a case where the determination value is less than the threshold.

13. The method according to claim 10, wherein in the determining, the determination value is determined in a case where the image forming unit forms an image for one page of a recording material.

14. The method according to claim 10, wherein the containing unit contains a developer including the toner, wherein the containing unit includes a agitating unit configured to stir the developer contained in the containing unit, and wherein in the determining, the determination value is determined at predetermined time intervals, while the agitating unit stirs the developer.

15. The method according to claim 10, wherein the threshold is 0.

16. The method according to claim 10, wherein in the controlling, the replenishment unit is prevented from replenishing the containing unit with the toner, in a case where a cumulative value of the determination value is less than a predetermined value.

17. The method according to claim 16, wherein the predetermined value corresponds to an amount of the toner with which the replenishment unit replenishes the containing unit in a case where the replenishment unit executes replenishment once.

18. The method according to claim 10, wherein the containing unit contains a developer including the toner, and wherein the detection unit outputs a signal according to a ratio of the toner to the developer contained in the containing unit.

* * * * *